US006171416B1

(12) United States Patent
Aratani et al.

(10) Patent No.: US 6,171,416 B1
(45) Date of Patent: Jan. 9, 2001

(54) METHOD OF PRODUCING CAN STEEL STRIP

(75) Inventors: Makoto Aratani; Yukio Kobata; Hideo Kuguminato; Akio Tosaka, all of Chiba; Masatoshi Aratani, Handa; Susumu Okada, Chiyoda, all of (JP)

(73) Assignee: Kawasaki Steel Corporation, Kobe (JP)

( * ) Notice: Under 35 U.S.C. 154(b), the term of this patent shall be extended for 0 days.

(21) Appl. No.: 09/426,886

(22) Filed: Oct. 26, 1999

(30) Foreign Application Priority Data

Nov. 25, 1998 (JP) ..... 10-334503

(51) Int. Cl.[7] ..... C21D 8/02

(52) U.S. Cl. ..... 148/643; 148/603; 148/653; 148/567

(58) Field of Search ..... 148/602, 603, 148/653, 654, 320, 643, 567

(56) References Cited

U.S. PATENT DOCUMENTS

| | | | | |
|---|---|---|---|---|
| 4,504,326 | * | 3/1985 | Tokunaga et al. | 148/603 |
| 5,534,089 | * | 7/1996 | Fujinaga et al. | 148/654 |
| 5,587,027 | * | 12/1996 | Tosaka et al. | 148/603 |
| 5,725,697 | * | 3/1998 | Fujinaga et al. | 148/603 |

FOREIGN PATENT DOCUMENTS

| | | |
|---|---|---|
| 0 659 889 A2 | 6/1995 | (EP) . |
| 0 826 436 A1 | 3/1998 | (EP) . |
| 4-063232 | 2/1992 | (JP) . |
| 9-176744 | 7/1997 | (JP) . |
| 9-241757 | 9/1997 | (JP) . |
| 9-327702 | 12/1997 | (JP) . |
| 10-046243 | 2/1998 | (JP) . |

* cited by examiner

*Primary Examiner*—Deborah Yee
(74) *Attorney, Agent, or Firm*—Oliff & Berridge, PLC

(57) ABSTRACT

At least both ends of a sheet bar in the length direction, which is obtained by roughly rolling a steel slab including 0.1 wt % or less of C, 0.5 wt % or less of Si, 1.0 wt % or less of Mn, 0.1 wt % or less of P, 0.05 wt % or less of S, 0.20 wt % or less of Al, and 0.015 wt % or less of N, are heated so that the temperature at both ends of the sheet bar in the length direction is 15° C. or more higher than the temperature of the remainder of the sheet bar. The rolling finish temperature is $Ar_3$+20° C. to $Ar_3$+100° C. in both end portions of the sheet bar in the length direction, and $Ar_3$+10° C. to $Ar_3$+60° C. in the remainder, and the rolling finish temperature in the both end portions in the length direction is 10° C. or more higher than that of the remainder, so that a steel strip after cold rolling and annealing has r values within ±0.3 of the average r value, and Δr within ±0.2 of the average Δr in the region of 95% or more of each of the total length and total width of the steel strip.

8 Claims, 1 Drawing Sheet

FIGURE
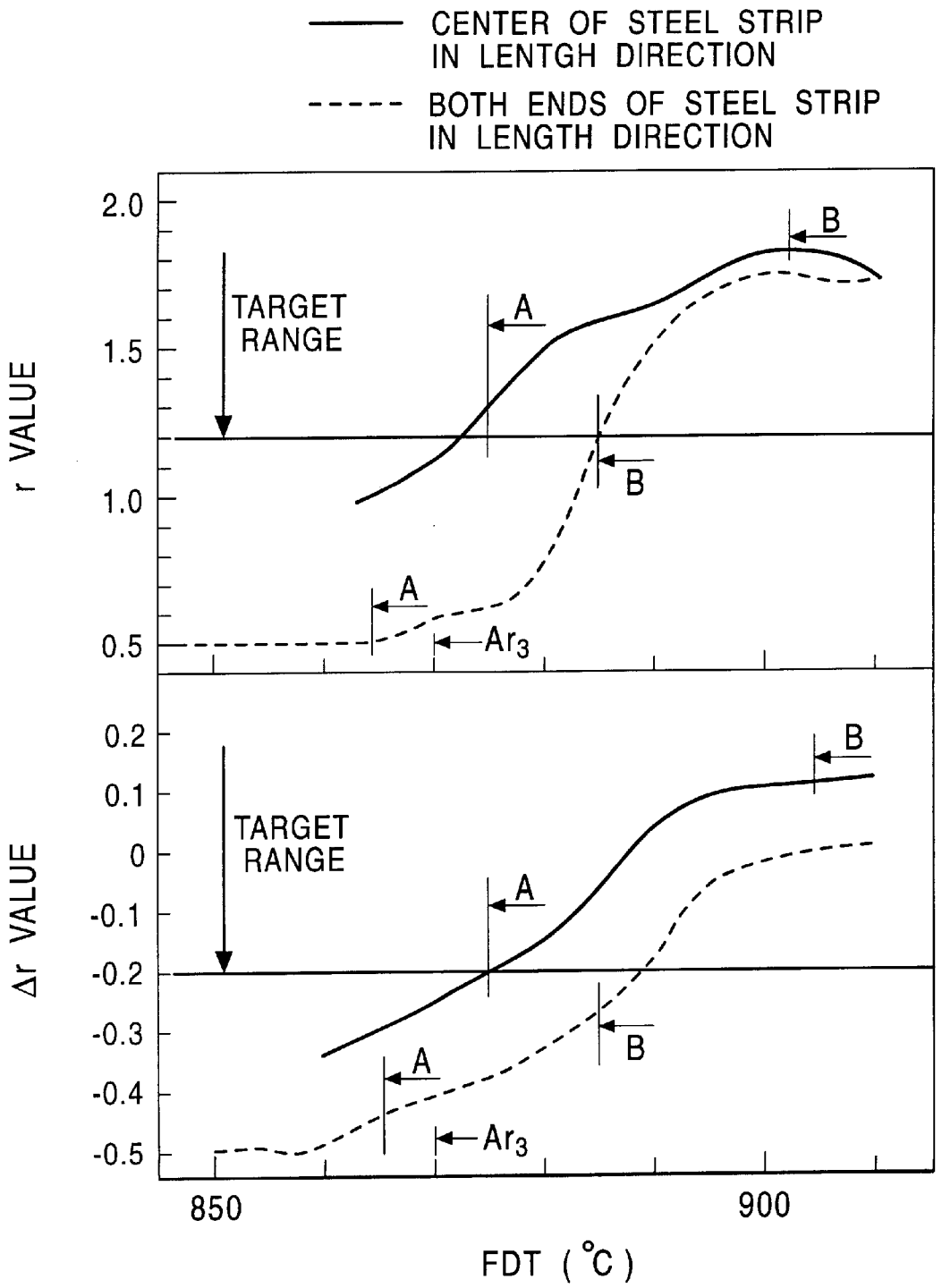

METHOD OF PRODUCING CAN STEEL STRIP

BACKGROUND OF THE INVENTION

1. Field of Invention

The present invention relates to can steel sheet and can steel strip and, particularly, to a can steel sheet and can steel strip having uniform material quality in both the width and length directions even in extremely thin and wide steel sheet and steel strip. The present invention also relates to a method of producing the can steel sheet and steel strip.

In the present invention, the can steel sheet and steel strip include surface-treated plates, such as by Sn plating, Ni plating, Cr plating and the like.

2. Description of the Related Art

A surface-treated steel sheet for cans is produced by the surface treatment of a plate by Sn, Ni or Cr plating or the like as a tin plate having a Sn deposit of 2.8 g/m$^2$ or more, or a lightly tin coated steel sheet having a Sn deposit of 2.8 g/m$^2$ or less, and is used for drink cans, food cans, etc.

Such can steel sheets are classified by their temper grade, which is represented by a target value of Rockwell T hardness (HR30T), so that single-rolled products are divided into T1 to T6, and double-rolled products are divided into DR8 to DR10.

In recent years, a further improvement in productivity of steel-fabricating process has been considered as a main object of can makers with increases in the consumption of drink cans. At the same time, activities for resources saving and cost reduction have also be continued. Therefore, it has recently been greatly demanded to provide can steel sheets satisfying these requirements of the can makers. Namely, a measure for improving productivity is an increase in the speed of the steel-fabricating work, and thus a steel sheet that causes no problems in high-speed steel fabrication is demanded.

Such a steel sheet must have hardness precision, dimensional precision of the steel sheet size including thickness, flatness, lateral bending precision, etc., all of which must be controlled more strictly than steel sheets for other use such as automobile steel sheets. For example, printing shift is affected by the flatness of a steel sheet, and the flatness is significantly affected by nonuniformity of material quality.

A rational steel-fabrication method has recently been established, in which a steel sheet is used over its entire width except for several millimeters of its ends in the width direction. From this point, it is necessary for a can steel strip to have uniform material quality and thickness over a whole coil.

In addition to the use of the steel sheet over its entire width, as a measure for resources saving and cost reduction, the weight of a can is decreased. Cans such as three-piece cans and two-piece cans can also be produced by using a thin steel sheet due to the recent progress in steel-fabrication technology, thereby tending to decrease the weight of a can.

With a thin steel sheet, the strength of a can is inevitably decreased. Therefore, the shape of a can is changed by necking in, and the strength of a can is improved by applying deep drawing, ironing, stretching, bulging, dome forming of the bottom, or the like after coating and baking. Recently, there has been a demand for a can steel thin sheet having excellent steel-fabrication workability and deep drawability.

Of course, it is demanded that these workabilities are uniform over a whole coil.

In order to improve the productivity of the steel-fabrication process with the recent progress in steel-fabrication technology, the width of a can steel strip, and the weight of a coil are increased, leading to production and supply of a steel strip having a width of 4 feet (about 1220 mm) or more, or a steel strip coil having a weight of 10 tons or more.

As described above, from the viewpoints of productivity, resources saving and cost reduction, it is necessary to supply a raw material used as a can steel sheet in the form of a steel strip coil having a small thickness, a large width and a heavy weight. It is also necessary that the material have high workability and uniformity in material quality in the width and length directions.

However, by conventional techniques, it is difficult to produce a thin and wide steel strip having uniform material quality over the entire width of a steel sheet, and the dimensions of a steel strip that can be produced practically include a thickness and a width both of which are limited to about 0.20 mm and 950 mm, respectively, from the viewpoint of passing ability of continuous annealing.

Even in the production of a steel strip having a width larger than 950 mm, it is difficult to obtain substantially uniform thickness and material quality over at least 95% of the whole width.

In order to comply with these requirements, Japanese Unexamined Patent Publication No. 9-327702 proposes a technique for producing a thin steel sheet by hot rolling, including cross-direction edge heating of a sheet bar using an edge heater, and pair cross rolling.

However, the method disclosed in the above Japanese Unexamined Patent Publication No. 9-327702 achieves uniform hardness in a steel strip and improves thickness precision and flatness, but causes the phenomenon that $\Delta r$ representing planar anisotropy of r value is high at both ends of the steel strip in the length direction, thereby causing the problem of reducing yield of the front and rear ends of the steel strip.

This $\Delta r$ is an important index for application to, particularly, two-piece cans.

Namely, in general, pressing of a tin plate does not require a high r value because a surface tin layer has a lubricating function during pressing. However, high planar anisotropy $\Delta r$ causes significant earring, and thus a necessary can height cannot be obtained, thereby causing the need to increase the disk diameter of the plate to be pressed. This is uneconomical due to deterioration in yield. Also, a can body has nonuniformity in thickness, causing damage to the wall surface of the can body due to galling, deterioration in precision of the can diameter, deterioration in can strength, etc.

Furthermore, a high $\Delta r$ value readily causes wrinkles in the upper portion of the can body, and readily causes wrinkles due to circumferential buckling in necking in. Therefore, coating adhesion and film adhesion deteriorate, and thus a rate of necking in cannot be increased, causing difficulties in decreasing the diameter of a can cover, and increasing the can strength. Also, the ear becomes a knife edge under high pressure in drawing, and the resultant iron pieces adhere to the mold and cause the problem of damaging the can surface, and various other problems. Although the progress in two-piece can steel-fabrication technology permits the use of a high-strength thin steel sheet, a portion with high $\Delta r$ cannot be used, and thus conventionally must be cut off and removed. Therefore, a can steel sheet having low $\Delta r$ and causing no earring is greatly demanded.

Japanese Unexamined Patent Publication No. 9-176744 proposes a method of improving uniformity in r values within a steel strip. Although this method comprises regulating the coiling temperature in the direction of the coil length, it is not necessarily an effective method because dynamic control of the coiling temperature in the coil causes defects in the shape of the coil, defects in pickling due to variations in pickling property, etc.

General factors which affect the above-described r value and Δr include (1) hot rolling conditions such as the finisher delivery temperature (FDT), the coiling temperature (CT), and the like, (2) the draft of cold rolling, (3) annealing conditions, etc., which must be optimized.

From these viewpoints, unlike an automobile steel sheet, the thickness of a hot-rolled finished can steel sheet is as small as 2 to 3 mm even if the reduction of cold rolling is set to a value of as high as about 90% of the upper limit ability of the rolling mill used because the product has a small thickness. Therefore, the hot rolling time is necessarily increased, and temperature decreases, particularly temperature decreases at the front and rear ends of the steel strip in the length direction and the ends in the width direction, are increased, thereby increasing nonuniformity in temperature within the coil. The nonuniformity in temperature decreases the r value, and increases Δr, increasing nonuniformity in these values in the steel strip. This makes production of a can steel strip very difficult.

In the future, this problem will be accompanied with the problem that as a coil of a can steel sheet, i.e., a can steel strip, is increased in weight, strength and width, and decreased in thickness to increase the need for a hot-rolled thin steel strip for decreasing a rolling load of cold rolling, a temperature difference in the steel strip during hot rolling, i.e., nonuniformity in material quality, further increases.

As described above, a thin and wide can steel strip having excellent quality and uniformity in properties is greatly demanded from the viewpoints that the production cost of the can body is decreased by decreasing the can weight, and that productivity is improved by widening the coil, i.e., the steel strip. However, the conventional technique of producing such a steel strip causes an increase in Δr at the ends of the steel strip in the width direction and at the ends in the length direction, and thus causes insufficient uniformity in Δr. This also causes a decrease in the r value, thereby making steel-fabrication press impossible. Therefore, in some applications of cans, the ends of a steel sheet in the length direction and width direction must be cut off and removed by trimming or the like, inevitably decreasing the yield.

In recent years, a so-called continuous hot-rolling technique has been brought into practical use, in which after rough rolling, sheet bars are successively joined to each other before finish rolling. Although, in this method, all ends in the length direction are expected to become stationary portions except the front end of the first sheet bar to be joined and the rear end of the last sheet bar to be joined, nonuniformity in material quality caused by the lower temperatures of the ends of the sheet bars than the centers is not completely eliminated under present conditions.

SUMMARY OF THE INVENTION

Accordingly, in consideration of the above-described problems of the known technology, it is an object of the present invention to provide a can steel strip having uniformity in material quality, particularly Δr and r values, within the steel strip, even if the can steel strip is very thin and wide. The present invention also provides a method of producing the can steel strip.

Another object of the present invention is to provide a can steel strip which can be tempered to soft temper grade T1, harder temper grades T2 to T6, and temper grades DR8 to DR10, which has uniformity in material quality including Δr even if it is very thin and wide, and which is suitable for the new steel-fabrication method. The present invention also provides a method of producing the can steel strip.

Still another object of the present invention is to provide a can steel strip having r values within ±0.3 of the average r values of the whole steel strip in the length and width directions in the ranges of 95% or more of the total length and width of the steel strip after temper rolling, and a Δr value within ±0.2 of the average Δr in the same manner. The present invention also provides a method of producing the can steel strip.

A further object of the present invention is to provide a can steel strip having improved material quality including a r value of 1.2 or more, and an absolute Δr value of 0.2 or less, and a method of producing the can steel strip. A still further object of the present invention is to achieve the above objects in a steel strip having a thickness of 0.20 mm or less and a width of 950 mm or more.

A further object of the present invention is to produce the above-described can steel strip without causing defects in the shape and variations in pickling property. The inventors discovered that an important factor concerning variations in material quality, particularly the r value and Δr, within a steel strip is the finisher delivery temperature, and that the above-described problems can be solved by appropriately controlling the finisher delivery temperature at a predetermined corresponding position of a sheet bar in the length direction of the sheet bar, leading to the achievement of the present invention. The present invention provides the following:

(1) A can steel strip that comprises 0.1 wt % or less of C, 0.5 wt % or less of Si, 1.0 wt % or less of Mn, 0.1 wt % or less of P, 0.05 wt % or less of S, 0.20 wt % or less of Al, and 0.015 wt % or less of N, wherein r values are within ±0.3 of the average r value, and Δr values are within ±0.2 of the average Δr in the range of 95% or more of each of the total length and total width of the steel strip.

In producing a can steel sheet according to known methods, unstationary portions in the length direction and/or width direction are cut off and removed in the step of hot-rolling or cold-rolling steel strip, thereby deteriorating productivity. However, the requirement that r values and Δr be within the predetermined ranges in the range of 95% or more is satisfied.

However, the present invention does not utilize such a solution. Namely, in the above-described construction, 95% of a steel strip means a steel strip having at least positions corresponding to the ends of a sheet bar in the length direction, with the ends in the width direction not removed or cut off and removed at the minimum for a desired reason such as for achieving the edge shape or the like.

(2) The can steel strip described above in (1) comprises 0.1 wt % or less of C, 0.5 wt % or less of Si, 1.0 wt % or less of Mn, 0.1 wt % or less of P, 0.05 wt % or less of S, 0.20 wt % of less or Al, 0.015 wt % or less of N, at least one element selected from at least one of the following groups A–C, and the balance comprising Fe and inevitable impurities:

Group A; Nb: 0.10 wt % or less, Ti: 0.20 wt % or less

Group B; B: 0.005 wt % or less

Group C; Ca: 0.01 wt % or less, REM: 0.01 wt % or less (3) The can steel strip described above in (1) or (2) comprises a surface-treated layer on at least one side of the can steel strip.

(4) A method of producing a can steel strip from a steel slab containing 0.1 wt % or less of C, 0.5 wt % or less of Si, 1.0 wt % or less of Mn, 0.1 wt % or less of P, 0.05 wt % or less of S, 0.20 wt % or less of Al, and 0.015 wt % or less of N comprises hot rolling, cold rolling, and annealing, wherein the rolling finish temperature of the hot rolling is $Ar_3$+20° C. to $Ar_3$+100° C. in portions corresponding to both ends of a sheet bar in the length direction, and $Ar_3$+10° C. to $Ar_3$+60° C. in the remainder, and the rolling finish temperature in the portions corresponding to both ends in the length direction is 10° C. or more higher than that of the remainder.

(5) A method of producing a can steel strip from a steel slab containing 0.1 wt % or less of C, 0.5 wt % or less of Si, 1.0 wt % or less of Mn, 0.1 wt % or less of P, 0.05 wt % or less of S, 0.20 wt % or less of Al, and 0.015 wt % or less of N comprises hot rolling, cold rolling, and annealing, wherein the hot rolling comprises heating at least both ends of a sheet bar obtained by rough rolling in the length direction by a sheet bar heater so that the temperatures at both ends of the sheet bar in the length direction are 15° C. or more higher than the temperature of the remainder, and then finish-rolling the sheet bar at a rolling finish temperature of $Ar_3$+10° C. or more.

(6) A method of producing a can steel strip from a steel slab containing 0.1 wt % or less of C, 0.5 wt % or less of Si, 1.0 wt % or less of Mn, 0.1 wt % or less of P, 0.05 wt % or less of S, 0.20wt % or less of Al, and 0.01 5wt % or less of N comprises hot rolling, cold rolling, and annealing, wherein the hot-rolling comprises butt-joining and continuously finish-rolling sheet bars obtained by rough rolling, heating at least both ends of the sheet bars in the length direction thereof by a sheet bar heater so that the temperatures of both ends of the sheet bars in the length direction thereof are 15° C. or more higher than the temperatures of the remainders, and then finish-rolling the sheet bars at a rolling finish temperature of $Ar_3$+10° C. or more.

BRIEF DESCRIPTION OF THE DRAWINGS

The FIGURE is a graph showing effects of the finisher delivery temperature (FDT) on r values and Δr of a can steel strip obtained by hot rolling, cold rolling and then annealing.

DETAILED DESCRIPTION OF PREFERRED EMBODIMENTS

First, a steel strip of the present invention has material quality including r values within ±0.3 of the average r value, and Δr within ±0.2 of average Δr, in the range of 95% or more of each of the total length and width of the steel strip.

The average r value and average Δr are determined by averaging r values and Δr of a total of 15 to 200 specimens including 5 to 20 specimens (5 specimens at a minimum, and preferably 20 specimens, hereinafter) collected from the steel strip in the length direction, and 3 to 10 specimens collected in the width direction. These averages are substantially equal to the r value and Δr at the center in each of the length direction and width direction. The r value and Δr are calculated by the equations, $r\ (r_L+r_C+2r_D)/4$, and $\Delta r=(r_L+r_C-2r_D)/2$ wherein $r_L$, $r_C$ and $2r_D$ are r values in the length direction, the width direction, and the diagonal direction at 45°, respectively.

The r values and Δr are preferably measured by applying uniform tensile deformation to a tensile specimen of JIS No. 5 or the like according to a conventional method. However, in a narrow measurement region such as the ends in the width direction, a small specimen having a gauge length of about 10 mm may be used.

These variation ranges are necessary for finishing a can shape with uniform dimensional precision according to design after steel fabrication and pressing, and decreasing the defective portions removed to improve yield. These values are preferably in the above ranges of variations over the total length and width of the steel strip. However, it is sufficient for practical use that the values are secured in the ranges of variations in a region of 95% or more of each of the total length and total width. Such a steel strip exhibiting small variations in the region of 95% or more of each of the total length and total width has not been obtained prior to the present invention.

The target properties of the can steel strip of the present invention include an r value of 1.2 or more, and an absolute Δr value of 0.2 or less. This is because an r value of at least 1.2 is necessary for processing required for cans, such as deep drawing, and an absolute Δr value of 0.2 or less is necessary for no earring property.

The steel strip of the present invention having these properties preferably has a strip size of 0.20 mm or less thick and 950 mm or more wide. This strip size is preferable because the effect of improving stable workability by suppressing variations in Δr is significant in the region of small thicknesses of 0.20 mm or less. This is also because with a width of 950 mm or more, the above-mentioned improvement in productivity due to widening can be expected.

The inventors carried out studies from the viewpoint that in order to produce a can steel strip having small variations of r values and Δr in the steel strip, it is important to make uniform the mechanical properties and crystal grain diameter of a hot-rolled steel strip beside using a homogeneous continuously cast slab comprising steel components with less segregation. Therefore, the mechanical properties and crystal grain diameters were studied in detail over the total width and total length of the hot-rolled steel strip.

As a result, it was found that at both ends in the width direction and length direction, i.e., the front and rear ends of a sheet bar in the length direction of the sheet bar, the crystal grain diameters are large, and the material is soft, as compared with the center. Then, the steel strip after pickling, cold rolling, continuous annealing, and temper rolling was also examined in the same manner as described above. As a result, the inventors obtained the fact that even if the ends of the hot-rolled steel strip in the width direction and length direction show not large differences in hardness and crystal grain diameter, the r value and Δr at the ends of the annealed and temper rolled steel strip are poorer than the center of the steel strip, actually exhibiting poor formability in pressing.

The inventors also found that in order to solve the problems of the cold-rolled steel strip, it is very effective to ensure a finisher delivery temperature (abbreviated to "FDT" hereinafter) of the $Ar_3$ temperature or more under predetermined conditions by heating the ends of a sheet bar in the length direction of the sheet bar with a heater (referred to as a "sheet bar heater" hereinafter). As the sheet bar heater, an induction heating type heater is preferred.

In order to homogenize the material in the length direction, it is generally thought to be necessary that FDT is made uniform in the length direction. However, the inventors found that variations in the r values, particularly Δr, are not eliminated even by setting FDT at the center and the ends in the length direction to the same temperature according to the conventional common knowledge. The possible reasons of such a phenomenon are as follows.

The temperatures of portions corresponding to the front and rear ends of a sheet bar in the length direction of the sheet bar vary in a lower temperature level than the center in the length direction to increase a temperature difference between the portions corresponding to the front and rear ends and the center in the length direction until hot rolling is finished. As a result, the grain diameter distributions of precipitates at the ends in the length direction are made fine. This affects grain growth in continuous annealing, and particularly changes the effect of the cold reduction on the cold rolling texture and recrystallization texture. Although described below, even in the use of an as-cold-rolled steel sheet, the steel sheet is annealed to some extent by baking. Therefore, in cold rolling of a can steel sheet under high reduction, the r values and Δr at the ends in the length direction are different from those at the center in the length direction, i.e. the ends in the length direction are apparently under higher reduction.

The FIGURE shows an example showing the effect of FDT on the r values and Δr which were determined at the center and both ends of a steel strip in the length direction of the steel sheet. The FIGURE indicates that by setting FDT of portions corresponding to both ends of a sheet bar in the length direction thereof to $Ar_3$+20° C. or more, and FDT of the remainder (the center in the length direction) to $Ar_3$+10° C. FDT, and also FDT of the portions corresponding to both ends of the sheet bar in the length direction thereof is 10° C. or more higher than that of the remainder, the r values and Δr can be set to r values of 1.2 or more, and Δr within ±0.2) suitable for a can steel strip, and the r value and Δr at the center in the length direction can be made substantially equal to those at both ends in the length direction.

Even at the same FDT, the values shown in the FIGURE fall in the ranges of the present invention. However, in consideration of variations in actual values due to factors such as variation in FDT within a control limit, deviations due to FDT between the center in the length direction and both ends in the length direction must be kept to about ½ or less of the ranges of variations of the present invention.

In order to satisfy the above temperature ranges at both ends of the sheet bar in the length direction thereof, a sheet bar heater must be used because of the insufficient heating ability of a conventional edge heater alone for heating both ends in the width direction. In order that the FDT at the ends in the length direction is higher than that at the center in the length direction, it is preferable to heat only the ends in the length direction by using the sheet bar heater before finish hot rolling. Naturally the center in the length direction may also be heated for controlling FDT according to demand. The FIGURE also shows the case of hot rolling under conditions in which the target FDT at the centers in the width direction and length direction is 900° C. In the FIGURE, region A indicates that the edge heater is required for heating the ends in the width direction, and region B indicates that the sheet bar heater is required for heating the center in the width direction.

The sheet bar heater is preferably set directly, specifically 30 m or less, ahead of a finisher from the viewpoint of heating cost. It is necessary to increase a temperature difference as the distance of the sheet bar heater from the finisher increases. In cases wherein sheet bars are joined to each other and then continuously finish-rolled, heating is preferably performed after joining. Because the front and rear ends, particularly the outer coiled portion of a sheet bar coil, is cooled during the time required for joining, it is undesirable to perform heating before joining.

In heating by the sheet bar heater, the finisher entrance temperature at the ends in the length direction is 15° C. or more higher than that at the center in the length direction, so that FDT at the ends in the length direction can be set to be 10° C. higher than that of the remainder.

In the case of continuous finish rolling after joining of the sheet bars, portions corresponding to the front and rear ends of the steel strip before joining already have a lower temperature history than the centers. Therefore, even in an integrated state after joining, it is necessary to provide a temperature difference.

The reason for providing the upper limits of FDT at the center in the length direction and the ends in the length direction is that at temperatures above the upper limits, Δr is increased due to the growth of crystal grains after hot rolling, thereby making unstable for a can steel sheet.

As means for homogenizing the material in the width direction, a temperature difference in the width direction is removed by using the edge heater, or by controlling a plate crown after hot rolling to a low level. Although, for convenience's sake, the FIGURE shows the FDT-r value and FDT-Δr relations as if the relations at the center in the width direction are the same as the ends in the width direction, these relations actually vary in the same manner as in the length direction. However, because nonstationary portions in the width direction are narrow, at the same FDT, material differences in the width direction are smaller than in the length direction. Therefore, it is sufficient to set the target FDT to substantially the same value. Specifically, FDT at the ends in the width direction may be kept at a temperature of (center temperature −10° C.) or more. Therefore, FET (finisher enter temparature) at the ends is preferably a temperature of (center temperature −5° C.) or more.

The typical method of producing a wide and thin steel strip for cans exhibiting small variations in r value will now be described.

Converter molten steel is degassed under vacuum according to demand, and a cast slab obtained by continuous casting is hot-rolled. For hot rolling, the slab is preferably heated to the $Ac_3$ point or more, specifically 950° C. to 1350° C. The slab heating temperature indicates the average temperature in thickness direction at the center of the slab in the width direction thereof, which can be calculated from the slab surface temperature and heating history.

The heated slab is hot-rolled so that the finish temperature is as described above to obtain a hot-rolled steel strip. In the present invention, unless otherwise specified, at both ends in the length direction, the finisher delivery temperature is represented by the steel strip surface temperature measured at the center in the width direction at positions of 2.5% of the total length on the finisher outlet side. At the center other than both ends in the length direction, the finisher delivery temperature is represented by the steel sheet surface temperature measured at the center in the width direction at the center in the length direction on the finisher outlet side.

For a can steel strip having a thickness of 0.200 mm or less, the thickness of the hot-rolled steel strip is preferably as small as 2.0 mm or less. With a thickness of over 2.0 mm, cold reduction for extremely thinning is increased to deteriorate r values and Δr, thereby causing difficulties in ensuring a good shape and deteriorating the cold rolling property. The minimum thickness of the hot-rolled steel strip is about 0.5 mm in consideration of mill power from the viewpoint of the limit which permits production of a homogeneous hot-rolled steel strip while preventing a temperature drop of the sheet bar when a slab having a large sectional thickness of about 260 mm is rolled.

In order to produce an extra thin hot-rolled steel strip having a thickness of 2.0 mm or less while maintaining high productivity, continuous rolling is preferred. From this viewpoint, the use of the method disclosed in Japanese Unexamined Patent Publication No. 9-327707 is advantageous because a wide and extra thin steel sheet having uniform hardness can be produced with less ear notch margin and high productivity.

The coiling temperature after hot rolling is preferably 550° C. or more, more preferably 600° C. or more. With a coiling temperature of less than 550° C., recrystallization is not sufficiently progressed and the crystal grain diameter of the hot-rolled sheet decreases. Therefore, even by continuous annealing after cold rolling, crystal grains of the cold-rolled sheet are small due to the small crystal grain diameter of the hot-rolled sheet, causing difficulties in obtaining a soft can steel sheet of T1 grade or the like.

In continuous rolling, sheet bars are preferably joined to each other within a short time in order to stably obtain the effect of the present invention. As a method of joining within a short time, for example, the sheet bars are joined by a joining apparatus which is moved corresponding to the speed of the sheet bars with joining of sheet bars timed so that the sheet bars can be joined to each other within a short time of 20 seconds or less. Then, the joints are butted and welded by electromagnetic induction heating or the like, followed by continuous rolling by a finisher. Then, the steel strip is divided by a shearing machine immediately ahead of a coiler, and coiled.

Even if the sheet bars are completely joined within a short time, it is difficult to sufficiently prevent temperature changes at both ends of each of the sheet bars in the length direction in a lower level than the remainder of each of the sheet bars. Therefore, the joints between the sheet bars are also considered as the both ends of the sheet bars in the length direction thereof, and thus heated to a higher temperature than the remainder.

Namely, in the present invention, "the both ends in the length direction" means the ends of the sheet bars before joining.

In general hot rolling, heterogeneity of the shape and properties inevitably caused by temperature decreases at the ends in the width direction is effectively removed by heating the ends in the width direction using the edge heater. Specifically, it is effective to heat the ends in the width direction about +50° C. to +110° C. by the edge heater.

The role of the sheet bar heater for heating the front and rear ends of the sheet bar has been described above. As a result of research performed by the inventors, it was found that in order to decrease variations in the r value, it is insufficient to set FDT to a uniform temperature above the $Ar_3$ transformation point in the width direction and length direction, and it is effective that FDT at a position where the temperature drops from the time of discharge from a heating furnace to the time of entrance into the finisher is set in the temperature range of $Ar_3$ transformation point +10° C. to +60° C. Particularly, at the front and rear ends of the sheet bar where the temperature significantly decreases, it is effective to ensure the higher temperature range of $Ar_3$ transformation point +20° C. to +100° C., and set the temperature of the center of the sheet bar to be immediately above the $Ar_3$ transformation point, thereby making FDT nonuniform in the length direction of the sheet bar. It was also found that it is effective to use the sheet bar heater, and use the edge heater according to demand. At a higher temperature beyond the above temperature range, a scale layer is formed thickly on the surface of the hot-rolled steel strip, which adversely affects productivity in the subsequent pickling step. Therefore, it is necessary to set FDT in the center of the sheet bar in the length direction thereof to $Ar_3$+60° C. or less, and FDT at the front and rear ends in the temperature range of $Ar_3$ transformation point +20° C. to +100° C.

As described above, although efforts are conventionally made to make FDT uniform at the $Ar_3$ transformation point or more over the entire region of the steel strip, such an operation consequently causes a significant increase in variation of the r value. However, in the present invention, the sheet bar heater is used so that the front and rear ends in the length direction are heated to high temperature, and if required, the center is heated to positively produce a temperature difference in FDT, thereby decreasing the variations of the r value. The FDT is preferably in a general temperature range, i.e., 860° C. or more.

The coiling temperature (CT) is 550° C. or more, preferably 600° C. or more, in order to sufficiently effect recrystallization. With a CT lower than 550° C., recrystallization is not sufficiently effected, thereby decreasing the crystal grain diameter of the hot-rolled sheet. Therefore, even when the hot-rolled sheet is annealed after cold rolling, the crystal grain diameter is small because of the small crystal grain diameter of the hot-rolled sheet, thereby causing difficulties in producing a soft can steel sheet of T1 grade or the like. With excessively high CT, a scale layer is formed thickly on the surface of the steel strip, deteriorating the descaling property in the next pickling step. Therefore, the upper limit of CT is preferably 750° C.

In cold rolling performed after hot rolling and pickling, in order to comply with the user request to decrease the thickness, the cold reduction is preferably increased. With a too low reduction, crystal grains are abnormally coarsened in the annealing step or made mix-sized, thereby deteriorating material quality, and it is difficult to develop the profitable texture for deep drawing properties. Therefore, the cold reduction is preferably 80% or more. However, with a high reduction of over 95%, even by using the steel components and production conditions of the present invention, the r value is decreased, and $\Delta r$ is increased to increase earring. Therefore, the upper limit of the cold reduction is preferably 95%.

As the annealing method after cold rolling, a continuous annealing method is preferred to achieve excellent uniformity in material quality, and high productivity. The annealing temperature of continuous annealing must be the recrystallization finish temperature or more. With a too high annealing temperature, crystal grains are abnormally coarsened to cause larger orange peel, after forming. For thin materials such as a can steel sheet, the possibility of causing a break or buckling in the furnace is increased. Therefore, the upper limit of the annealing temperature is preferably 800° C. In the case of continuous annealing, overaging can be carried out under temperature and time conditions of 400 to 600° C. and 20 seconds to 3 minutes, respectively, according to a conventional method.

In the case of a steel sheet containing $C \leqq 0.004$ wt %, the steel sheet is annealed to some extent in a low-temperature heating step for coating and baking a laminated coating even without conventional annealing, to exhibit sufficient workability. The present invention includes this case of annealing. In this case, the heating temperature is about 200 to 300° C.

Although the cold reduction of temper rolling is appropriately determined according to the temper grade of a steel sheet, it is necessary to perform rolling with a reduction of 0.5% or more in order to prevent the occurrence of stretcher strain. On the other hand, rolling with a reduction exceeding 40% excessively hardens the steel sheet, thereby deteriorating workability as well as decreasing the r value and increasing anisotropy of the r value. Therefore, the upper limit of the cold reduction is preferably 40%.

Temper rolling with a cold reduction appropriately selected in the reduction range, e.g., in the range of 0.5% to 40%, permits the achievement of temper grades of Ti to T6 and DR8 to DR10 using low-carbon and ultra low-carbon annealed materials.

The above-described method can produce the cold-rolled steel strip having uniform r values and Δr in the range of 95% of each of the total length and total width of the steel strip, and a desired temper grade. The surface of the cold-rolled steel strip is treated by an appropriate combination of Sn, Cr, or Ni plating, plastic coating and if required, chromating, to produce a wide and extra thin can steel sheet having excellent rust resistance and corrosion resistance.

If required, treatment such as hot-rolled sheet annealing may be added to the above process.

Next, the composition of steel is described together with the reasons for limiting the composition.

C: 0.1 wt % or less

The amount of C dissolved in a ferrite phase is about 1/10 to 1/100 of N. Thus, as in a box annealing method, strain aging of a slowly cooled steel sheet is mainly influenced by the behavior of N atoms. However, in the continuous annealing method, C is not sufficiently precipitated due to an extremely high cooling rate, and thus a large amount of C remains dissolved, adversely affecting strain aging. Also, C is an important element which influences the crystallization temperature and suppresses the growth of recrystallized grains. In the box annealing method, the crystal grain diameter is decreased due to an increase in the C amount, causing hardening, while in the continuous annealing, there is no simple tendency that hardening occurs with an increase in the C amount.

With an extra small C amount of about 0.004 wt % or less, softening occurs, while an increase in the C amount shows a hardness peak at a C amount of about 0.01 wt %, and a further increase in the C amount conversely decreases hardness to cause a hardness minimum in the C amount range of 0.02 to 0.07 wt %. A further increase in the C amount again increases hardness.

In the present invention, a can steel sheet can be produced according to required hardness, particularly without vacuum degassing. However, in order to avoid excessive hardening and deterioration in the rolling property, and produce a steel sheet suitable for cans by the continuous annealing method, the C amount must be 0.1 wt % or less.

With an ultra low C amount of about 0.004 wt % or less, softening occurs, but vacuum degassing is required in the steel making process. Therefore, in order to economically and practically produce a temper grade of T3 or more, the C amount is preferably controlled to 0.004 to 0.05 wt %. In this range, the amount of HAZ hardening due to welding can also be suppressed to a low level. The C range of 0.02 wt % or more is more preferable because of softening and no need for vacuum degassing. In order to produce a soft tin plate having a temper grade of T1 or more by the continuous annealing method with serious demand of workability, particularly deep drawability, the C amount is preferably 0.004 wt % or less. In order to omit continuous annealing, it is necessary to set the hardness after cold rolling to a target hardness or less. In this case, the C amount is preferably decreased to an extremely low value of 0.002 wt % or less.

However, with an extremely low C amount, the $Ar_3$ transformation point is increased to cause difficulties in ensuring the rolling temperature, and the coarsening of the crystal gains occur, which causes orange peeling or the like in pressing. Therefore, the C amount is preferably 0.005 wt % or more.

Si: 0.5 wt % or less

Because Si is an element which deteriorates corrosion resistance of a tin plate, and significantly hardens materials, it is necessary to avoid an excessive addition of Si. Particularly, with a Si amount of over 0.5 wt %, hardening makes the production of a soft tin plate difficult. Therefore, it is necessary to limit the Si amount to 0.5wt % or less, preferably 0.03 wt % or less.

A Si amount of 0.01 wt % or less causes an increase in cost, and is thus economically undesirable. Therefore, the lower limit of Si amount is preferably 0.01 wt % or more.

Mn: 1.0 wt % or less

Mn is necessary for preventing the occurrence of edge cracks in a hot-rolled steel strip due to S. With a low S amount, it is unnecessary to add Mn. However, because S is inevitably contained in steel, 0.05 wt % or more of Mn is preferably added. With a Mn amount of over 1.0 wt %, crystal grains are made fine to cause hardening in combination with solid solution strengthening. Therefore, the Mn amount must be 1.0 wt % or less, preferably in the range of 0.60 wt % or less.

P: 0.1 wt % or less

Because P hardens materials and deteriorates corrosion resistance of a tin plate, excessive content of P is undesirable. Therefore, the P amount must be limited to 0.1 wt % or less, preferably 0.02 wt % or less.

In consideration of the cost of dephosphorization in steel making, the lower limit is preferably 0.005 wt %.

S: 0.05 wt % or less

Excessive content of S causes supersaturation of S dissolved in the high-temperature γ region in hot rolling with a decrease in temperature, precipitation of (Fe, Mn)S in γ grain boundaries, thereby causing edge cracks in a hot-rolled steel strip which is called hot shortness. This also causes existence of sulfide inclusions which causes pressing defects. Therefore, the S amount must be 0.05 wt % or less, preferably 0.02 wt % or less.

With an excessively low S amount, scales are produced on the surface of the hot-rolled steel strip, deteriorating property of peeling off. In consideration of the cost of desulfurization in steel making, further the lower limit is preferably 0.001 wt % or more.

With a Mn/S ratio of less than eight, edge cracks and pressing defects easily occur. Therefore, the Mn/S ratio is preferably eight or more.

Al: 0.20 wt % or less

Al is an element which functions as a deoxidizer in the steel producing process, and which is preferably added for increasing cleanliness. However, excessive addition of Al not only is economically undesirable, but also suppresses the growth of recrystallized grains. Therefore, the Al content must be in the range of 0.20 wt % or less. Because Al is useful for improving the cleanliness of a tin plate and fixing dissolved N to obtain a soft tin plate, 0.02 wt % or more of Al is preferably added.

However, for example, when a component having a deoxidizing effect, such as Ti, Ca, Si, or the like, is used as the main deoxidizing element, the Al content may be further decreased to, for example, 0.010 wt % or less, regardless of the lower limit.

N: 0.015 wt % or less

In the steel making process, when atmospheric N is mixed and dissolved in steel, a soft steel sheet cannot be obtained. Therefore, in producing a soft material, it is necessary to suppress mixing of atmospheric N as much as possible in the steel making process to control N to 0.0030 wt % or less. However, because N is a very effective element for easily producing a harder material at low cost, a N-containing gas may be blown into melted steel during refining so as to obtain a N content corresponding to the target hardness (HR30T). In this case, the upper limit having no adverse effect on workability is 0.015 wt %. In consideration of production cost, the lower limit is preferably 0.001 wt % or more.

Besides the above basic components, Nb or Ti (Group A) for improving cleanliness and fixing C and N in steel, B (Group B) for suppressing grain boundary brittleness, and Ca or REM (Group C) for deoxidizing and controlling the form of a nonmetallic inclusion may be added as desired.

One or two elements selected from any one of these groups, or one or two elements selected from each of at least two groups may be added.

Nb: 0.10 wt % or less

Nb not only functions to improve cleanliness but also to form a carbide and nitride to decrease the amounts of residual C and N dissolved in steel. However, excessive addition of Nb increases the crystallization temperature due to the pinning effect of Nb precipitates in the grain boundaries, thereby deteriorating the plate passing ability of the strip in the continuous annealing furnace and decreasing the gain size. Therefore, the Nb content is in the range of 0.10 wt % or less. The lower limit of the adding amount is preferably 0.001 wt % or more necessary for exhibiting the effect of Nb.

Ti: 0.20 wt % or less

Ti not only functions to improve cleanliness but also to form a carbide and nitride to decrease the amounts of residual C and N dissolved in steel. However, excessive addition of Ti causes the occurrence of sharp and hard precipitates, thereby deteriorating corrosion resistance and causing scratches in pressing. Therefore, the Ti content is 0.20 wt % or less. The lower limit of the Ti added is preferably 0.001 wt % or more necessary for exhibiting the effect of Ti.

B: 0.005 wt % or less

B is effective for suppressing grain boundary brittleness. Namely, when a carbide forming element is added to ultra low carbon steel to significantly decrease the amount of C dissolved, the strength of recrystallized grain boundaries is decreased, which may cause the cracking by brittleness when a can is stored at low temperature. In order to obtain good quality even in such an application, addition of B is effective.

Although B is also an element effective for softening by forming a carbide and nitride, B slows recrystallization by segregation in the recrystallized grain boundaries in continuous annealing. Therefore, the amount of B added is 0.005 wt % or less. The lower limit of the amount of B added is preferably 0.0001 wt % or more necessary for exhibiting the effect of B.

Ca: 0.01 wt % or less. REM: 0.01 wt % or less

Ca and/or REM is effective for deoxidizing and controlling the form of a nonmetallic inclusion, and is added according to need. However, excessive addition deteriorates corrosion resistance and workability. Therefore, these elements are added in an amount of 0.01 wt % or less respectirely, preferably a total in the range of 0.0005 to 0.0030 wt %. O forms oxides with Al and Mn in steel, Si in refractories, Ca, Na, F, and the like in fluxes, and causes cracks in pressing or deterioration in corrosion resistance. Therefor, it is necessary to decrease the 0 amount as much as possible, and the upper limit is preferably 0.01 wt % or less.

The balance other than the above-described elements comprises Fe and inevitable impurities. The inevitable impurities include contaminants mixed from raw materials or scraps, such as Cu, Ni, Cr, Mo, Sn, Zn, Pb, V, and the like. However, where the amount of each of Cu, Ni, and Cr is 0.2 wt % or less, and the amount of each of Mo, Sn, Zn, Pb, V, and other elements is 0.1 wt % or less, effects on the characteristics of the can used are negligible.

EXAMPLES

Steel components having each of the compositions shown in TABLE 1 below were melted by a 270-t bottom blow converter, and cast by a continuous casting machine to form a cast slab. The cast slab was heated to 1100° C. in a heating furnace, and roughly rolled to obtain a sheet bar. The sheet bar was joined to a previously formed sheet bar by an induction heating system, and the regions of 10 m from the front and rear ends of the sheet bars were heated by an induction heating type sheet bar heater provided at a position 20 m ahead of a finisher. The regions of 15 mm from the ends in the width direction were heated alike by an induction heating edge heater to continuously roll the sheet bars by the finisher. Furthermore, hot rolling was carried out under the various combinations and FDT conditions shown in TABLE 2 below, such as single rolling without jointing of sheet bars, heating without using the sheet bar heater (Comparative Example), etc.

TABLE 3 below shows differences in the FET (finisher entry temperature) and differences in the FDT between the portions corresponding to the ends of the sheet bar in the length direction and the portion corresponding to the center, differences between the FDT and $Ar_3$ transformation temperature at each position of a sheet bar, and differences in the FDT between positions in the width direction, which were determined from the values shown in TABLE 2.

A hot-rolled steel strip having a thickness of 0.6 to 2.0 mm and a width of 950 to 1300 mm was obtained by the above-described method, descaled by pickling, and then rolled by a cold rolling mill to an ultra thin and wide cold-rolled steel strip. Then, continuous annealing was carried out with the cold reduction of temper rolling controlled to produce steel sheets having various temper grades. TABLE 4 below shows the conditions of cold rolling and temper rolling. The conditions of annealing after cold rolling were as shown in TABLE 5 below according to the C amount.

The can steel sheet (plating plate before plating) obtained in the above-described steps was used as a specimen for measuring hardness, r values and Δr. The results are shown in TABLES 4, 6 and 7 below.

In the examples, the total length of the steel strip was 1000 to 1600 m, the portion corresponding to the front end of a coil in the length direction means the portion of about 2 m from the front end, the portion corresponding to the rear end means the portion of about 7 m from the rear end, and the portion corresponding to the center means the substantially central portion in the steel strip in the length direction. The r value and Δr were measured at twenty positions along the length direction and five positions along the width direction to determine variations.

The distributions of the r value and Δr showed small variations when both ends of the sheet bar in the length direction were heated by using the sheet bar heater in the temperature range of the present invention. In contrast, when the sheet bar heater was not used, or when heating was insufficient even by using the sheet bar heater, the r value and Δr showed large variations, and the initial target could not be achieved.

The plating plate was tinned with a deposit of 2.8 g/m$^2$ to be finished to a tin plate. After the tin plate was formed into a cylinder, the ends were welded by seam-welding to produce a body of a three-piece can, followed by four-step, die necked-in forming with a height of 4 mm per step and a diameter reduction of 1.4 mmn. After the four-step, die necked-in forming, examination was made as to whether cercumferential buckling occurred (x) or not (o). In addition, a polyethylene terephthalate film having a thickness of 12 μm was heat-bonded to the surface and back of the tin plate to laminate films. Then, DRD (Drawn and Redrawn) cans were produced under conditions including a punching diameter 125.9 mm, and a draw diameter of 75.1 mm, and a draw height of 31.8 mm, and scratches on the can walls were visually examined. The thus-produced cans were classified into cans (o) that had no scratches and good performance as food cans, and cans (x) that had scratches and could not resist use as food cans. The results are also shown in TABLE 7 below. In all cases, the work test was carried out over the entire region of the steel strip from which regions of 5% of each end of the total length and total width of the coil were removed. When only one can was determined as x due to having scratches, whole strip was considered as x.

As a result of evaluation of steel fabrication workability by the above tests, it was found that examples of the present invention showed no occurrence of defects, and very good results.

As seen from the above examples, it was found that the present invention can produce an extra thin and wide can steel sheet having uniform r value and Δr in a steel strip. In addition, the present invention can produce an extra thin steel sheet for cans having properties suitable for processing to lightweight cans.

As described above, in the present invention, the portions corresponding to both ends of a sheet bar in the length direction of the sheet bar are heated to a temperature higher than the center of the sheet bar during hot rolling, and rolling is completed in the predetermined temperature range, so that a can steel sheet having uniform r values and Δr can be provided. The present invention also achieves production with high quality and high yield because of the absence of shape defects of steel strips, variations in pickling property, etc.

TABLE 1

| | Steel Composition (wt %) | | | | | | | | | | | | | | $Ar_3$ transformation temperature |
|---|---|---|---|---|---|---|---|---|---|---|---|---|---|---|---|
| NUMBER | C | Si | Mn | P | S | Al | N | O | Nb | Ti | B | Ca | REM | Mn/S | (° C.) |
| 1 | 0.002 | 0.02 | 0.13 | 0.011 | 0.016 | 0.062 | 0.0026 | 0.0022 | 0.004 | — | — | — | — | 8 | 880 |
| 2 | 0.002 | 0.02 | 0.13 | 0.011 | 0.016 | 0.062 | 0.0026 | 0.0022 | 0.004 | — | — | — | — | 8 | 880 |
| 3 | 0.002 | 0.02 | 0.13 | 0.011 | 0.016 | 0.062 | 0.0026 | 0.0022 | 0.004 | — | — | — | — | 8 | 880 |
| 4 | 0.002 | 0.02 | 0.13 | 0.011 | 0.016 | 0.062 | 0.0026 | 0.0022 | 0.004 | — | — | — | — | 8 | 880 |
| 5 | 0.002 | 0.02 | 0.13 | 0.011 | 0.016 | 0.062 | 0.0026 | 0.0022 | 0.004 | — | — | — | — | 8 | 880 |
| 6 | 0.002 | 0.02 | 0.13 | 0.011 | 0.016 | 0.062 | 0.0026 | 0.0022 | 0.004 | — | — | — | — | 8 | 880 |
| 7 | 0.002 | 0.02 | 0.13 | 0.011 | 0.016 | 0.062 | 0.0026 | 0.0022 | 0.004 | — | — | — | — | 8 | 880 |
| 8 | 0.002 | 0.02 | 0.13 | 0.011 | 0.016 | 0.062 | 0.0026 | 0.0022 | 0.004 | — | — | — | — | 8 | 880 |
| 9 | 0.002 | 0.02 | 0.13 | 0.011 | 0.016 | 0.062 | 0.0026 | 0.0022 | 0.004 | — | — | — | — | 8 | 880 |
| 10 | 0.002 | 0.02 | 0.13 | 0.011 | 0.016 | 0.062 | 0.0026 | 0.0022 | 0.004 | — | — | — | — | 8 | 880 |
| 11 | 0.024 | 0.01 | 0.24 | 0.018 | 0.015 | 0.022 | 0.0146 | 0.0045 | 0.018 | 0.0162 | 0.0030 | — | — | 16 | 836 |
| 12 | 0.035 | 0.02 | 0.48 | 0.007 | 0.009 | 0.074 | 0.0062 | 0.0142 | — | — | — | — | — | 53 | 814 |
| 13 | 0.037 | 0.03 | 0.56 | 0.012 | 0.014 | 0.185 | 0.0059 | 0.0021 | 0.078 | — | 0.0025 | — | — | 40 | 805 |
| 14 | 0.069 | 0.02 | 0.14 | 0.019 | 0.009 | 0.065 | 0.0045 | 0.0046 | — | — | — | — | — | 16 | 830 |
| 15 | 0.068 | 0.03 | 0.17 | 0.012 | 0.014 | 0.097 | 0.0048 | 0.0032 | 0.078 | 0.1820 | — | — | — | 12 | 826 |
| 16 | 0.091 | 0.03 | 0.21 | 0.017 | 0.015 | 0.022 | 0.0025 | 0.0033 | — | — | — | — | — | 14 | 815 |
| 17 | 0.002 | 0.01 | 0.15 | 0.009 | 0.012 | 0.035 | 0.0020 | 0.0031 | — | — | — | — | — | 13 | 880 |
| 18 | 0.032 | 0.02 | 0.55 | 0.010 | 0.015 | 0.042 | 0.0022 | 0.0028 | — | — | — | — | — | 37 | 809 |
| 19 | 0.035 | 0.02 | 0.25 | 0.010 | 0.009 | 0.039 | 0.0025 | 0.0033 | — | — | — | 0.005 | — | 28 | 830 |
| 20 | 0.035 | 0.03 | 0.24 | 0.010 | 0.010 | 0.040 | 0.0024 | 0.0032 | — | — | — | — | 0.004 | 24 | 870 |

TABLE 2

| | | Hot rolling condition | | | | | | | |
|---|---|---|---|---|---|---|---|---|---|
| | | | | | | FET of each corresponding portion–FET of portion corresponding to center (° C.) | | | |
| | | | | | | Portion corresponding to front end | | Portion corresponding to rear end | |
| No | Remark | Rolling method | Sheet bar heater | Sheet bar edge heater | $Ar_3$ (° C.) | 25 mm from end* | Center* | 25 mm from end* | Center* |
| 1 | This | Single | Use | Use | 880 | 26 | 40 | 43 | 57 |
| 2 | invention | Single | Use | Use | 880 | 26 | 39 | 47 | 55 |
| 3 | | Continuous | Use | Use | 880 | 18 | 42 | 33 | 42 |
| 4 | | Continuous | Use | Use | 880 | 19 | 28 | 30 | 47 |
| 5 | | Continuous | Use | Use | 880 | 16 | 27 | 38 | 52 |
| 6 | | Continuous | Use | Use | 880 | 28 | 37 | 35 | 33 |
| 7 | | Continuous | Use | Use | 880 | 17 | 24 | 44 | 54 |
| 8 | Comp. | Continuous | Use | Use | 880 | −6 | −3 | 11 | 5 |
| 9 | Example | Continuous | Non-use | Use | 880 | −65 | −57 | −42 | −37 |
| 10 | | Single | Use | Use | 880 | −34 | −33 | −15 | −5 |
| 11 | This | Single | Use | Non-use | 836 | 15 | 16 | 35 | 37 |
| 12 | invention | Continuous | Use | Use | 814 | 38 | 31 | 41 | 46 |
| 13 | | Continuous | Use | Use | 805 | 31 | 30 | 59 | 62 |
| 14 | | Continuous | Use | Use | 830 | 16 | 21 | 43 | 50 |
| 15 | | Continuous | Use | Use | 826 | 44 | 23 | 48 | 53 |
| 16 | | Continuous | Use | Non-use | 815 | 20 | 26 | 47 | 51 |
| 17 | | Continuous | Use | Use | 880 | 15 | 26 | 28 | 47 |
| 18 | | Continuous | Use | Use | 809 | 22 | 18 | 33 | 40 |
| 19 | | Continuous | Use | Use | 830 | 20 | 15 | 40 | 53 |
| 20 | | Continuous | Use | Use | 870 | 24 | 23 | 34 | 44 |

| | Hot rolling condition | | | | | | | | |
|---|---|---|---|---|---|---|---|---|---|
| | FDT of each portion corresponding to sheet bar (° C.) | | | | | | | | |
| | Portion corresponding to front end | | Portion corresponding to center | | Portion corresponding to rear end | | | | |
| No | 25 mm from end* | Center* | 25 mm from end* | Center* | 25 mm from end* | Center* | Coiling temp. (° C.) | Thickness (mm) | Width (mm) |
| 1 | 955 | 959 | 938 | 927 | 974 | 977 | 610 | 2.0 | 1300 |
| 2 | 956 | 958 | 934 | 922 | 978 | 978 | 621 | 2.0 | 1300 |
| 3 | 954 | 959 | 939 | 928 | 967 | 965 | 642 | 2.0 | 1200 |
| 4 | 948 | 943 | 935 | 923 | 961 | 962 | 688 | 1.8 | 1200 |
| 5 | 938 | 942 | 928 | 916 | 958 | 962 | 691 | 1.6 | 1000 |
| 6 | 933 | 938 | 912 | 909 | 942 | 938 | 709 | 1.2 | 950 |
| 7 | 910 | 905 | 893 | 890 | 935 | 935 | 710 | 1.0 | 950 |
| 8 | 923 | 922 | 930 | 929 | 935 | 933 | 650 | 2.0 | 1300 |
| 9 | 878 | 888 | 947 | 951 | 907 | 913 | 655 | 2.0 | 1200 |
| 10 | 900 | 897 | 938 | 936 | 920 | 925 | 733 | 1.2 | 950 |
| 11 | 857 | 865 | 847 | 853 | 875 | 885 | 652 | 1.8 | 1200 |
| 12 | 910 | 901 | 874 | 872 | 914 | 910 | 640 | 1.6 | 1000 |
| 13 | 848 | 839 | 825 | 817 | 871 | 872 | 628 | 1.2 | 950 |
| 14 | 908 | 898 | 890 | 886 | 928 | 930 | 642 | 0.8 | 1200 |
| 15 | 909 | 891 | 872 | 869 | 913 | 918 | 669 | 0.8 | 1200 |
| 16 | 867 | 874 | 847 | 854 | 889 | 898 | 672 | 0.6 | 1000 |
| 17 | 949 | 941 | 938 | 921 | 959 | 961 | 665 | 1.8 | 1200 |
| 18 | 842 | 830 | 825 | 819 | 850 | 851 | 645 | 1.8 | 1200 |
| 19 | 898 | 887 | 880 | 876 | 918 | 923 | 600 | 1.8 | 1200 |
| 20 | 947 | 938 | 926 | 918 | 957 | 956 | 540 | 1.8 | 1200 |

*In the width direction

FET: Finisher Entrance Temperature

FDT: Finisher Delivery Temperature

TABLE 3

| No | Remark | FET at position of 25 mm from end in the width direction–FET at center in the width direction: Front end *1 | Center *1 | Rear end *1 | FDT–$Ar_3$ (° C.) Portion corresponding to front end 25 mm: from end *2 | Center *2 | Portion corresponding to center 25 mm: from end *2 | Center *2 | Portion corresponding to rear end 25 mm: from end *2 | Center *2 |
|---|---|---|---|---|---|---|---|---|---|---|
| 1 | This | 2 | 16 | 2 | 75 | 79 | 58 | 47 | 94 | 97 |
| 2 | invention | 1 | 14 | 6 | 76 | 78 | 54 | 42 | 98 | 98 |
| 3 | | −2 | 22 | 13 | 74 | 79 | 59 | 48 | 87 | 85 |
| 4 | | 12 | 21 | 4 | 68 | 63 | 55 | 43 | 81 | 82 |
| 5 | | 4 | 15 | 1 | 58 | 62 | 48 | 36 | 78 | 82 |
| 6 | | 0 | 9 | 11 | 53 | 58 | 32 | 29 | 62 | 58 |
| 7 | | 10 | 17 | 7 | 30 | 25 | 18 | 10 | 55 | 55 |
| 8 | Comp. | 4 | 7 | 13 | 43 | 42 | 50 | 49 | 55 | 53 |
| 9 | Example | −5 | 3 | −2 | −2 | 8 | 67 | 71 | 27 | 33 |
| 10 | | 8 | 9 | −1 | 20 | 17 | 58 | 56 | 40 | 45 |
| 11 | This | −1 | 0 | −2 | 21 | 29 | 11 | 17 | 39 | 49 |
| 12 | invention | 16 | 9 | 4 | 96 | 87 | 60 | 58 | 100 | 96 |
| 13 | | 12 | 11 | 8 | 43 | 34 | 20 | 12 | 66 | 67 |
| 14 | | 7 | 12 | 5 | 78 | 68 | 60 | 56 | 98 | 100 |
| 15 | | 25 | 4 | −1 | 83 | 65 | 46 | 43 | 87 | 92 |
| 16 | | −6 | 0 | 4 | 52 | 59 | 32 | 39 | 74 | 83 |
| 17 | | 10 | 21 | 2 | 69 | 61 | 58 | 41 | 79 | 81 |
| 18 | | 18 | 14 | 7 | 33 | 21 | 16 | 10 | 41 | 42 |
| 19 | | 18 | 13 | 0 | 68 | 57 | 50 | 46 | 88 | 93 |
| 20 | | 16 | 15 | 5 | 77 | 68 | 56 | 48 | 87 | 86 |

| No | FDT of corresponding portion–FDT of portion corresponding to center (° C.) 25 mm: from end *2 | Center *2 | 25 mm: from end *2 | Center *2 | FDT at position of 25 mm from end in the width direction–FDT at center in the width direction: Front end *1 | Center Center *1 | Rear end *1 |
|---|---|---|---|---|---|---|---|
| 1 | 17 | 32 | 36 | 50 | −4 | 11 | 3 |
| 2 | 22 | 36 | 44 | 56 | −2 | 12 | 0 |
| 3 | 15 | 31 | 28 | 37 | −5 | 11 | 2 |
| 4 | 13 | 20 | 26 | 39 | 5 | 12 | −1 |
| 5 | 10 | 26 | 30 | 46 | −4 | 12 | −4 |
| 6 | 21 | 29 | 30 | 29 | −5 | 3 | 4 |
| 7 | 12 | 15 | 37 | 45 | 5 | 8 | 0 |
| 8 | −7 | −7 | 5 | 5 | 1 | 1 | 2 |
| 9 | −69 | −63 | 40 | −38 | −10 | −4 | −6 |
| 10 | −38 | −39 | −18 | −11 | 3 | 2 | −5 |
| 11 | 10 | 12 | 28 | 32 | −8 | −6 | −10 |
| 12 | 36 | 29 | 40 | 38 | 9 | 2 | 4 |
| 13 | 23 | 22 | 46 | 55 | 9 | 8 | −1 |
| 14 | 18 | 12 | 38 | 44 | 10 | 4 | −2 |
| 15 | 37 | 22 | 41 | 49 | 18 | 3 | −5 |
| 16 | 20 | 20 | 42 | 44 | −7 | −7 | −9 |
| 17 | 11 | 20 | 21 | 40 | 8 | 17 | −2 |
| 18 | 17 | 11 | 25 | 32 | 12 | 6 | −1 |
| 19 | 18 | 11 | 38 | 47 | 11 | 4 | −5 |
| 20 | 21 | 20 | 31 | 38 | 9 | 8 | 1 |

*1: Corresponding portions
*2: In the width direction

TABLE 4

| No | Remark | Cold rolling: Inlet side thickness (mm) | Outlet side thickness (mm) | reduction cold rolling (%) | Temper rolling: Outlet side thickness (mm) | Reduction (%) | Temper grade | Hardness of plating plate (HR30T) |
|---|---|---|---|---|---|---|---|---|
| 1 | This invention | 2.0 | 0.211 | 89.5 | 0.200 | 5 | T1 | 50 |
| 2 | This invention | 2.0 | 0.222 | 88.9 | 0.200 | 10 | T3 | 57 |

TABLE 4-continued

| No | Remark | Cold rolling | | | Temper rolling | | | Hardness of |
|---|---|---|---|---|---|---|---|---|
| | | Inlet side thickness (mm) | Outlet side thickness (mm) | reduction cold rolling (%) | Outlet side thickness (mm) | Reduction (%) | Temper grade | plating plate (HR30T) |
| 3 | This invention | 2.0 | 0.235 | 88.3 | 0.200 | 15 | T4 | 61 |
| 4 | This invention | 1.8 | 0.225 | 87.5 | 0.180 | 20 | T5 | 65 |
| 5 | This invention | 1.6 | 0.214 | 86.7 | 0.150 | 30 | DR8 | 73 |
| 6 | This invention | 1.2 | 0.200 | 83.3 | 0.130 | 35 | DR9 | 76 |
| 7 | This invention | 1.0 | 0.167 | 84.3 | 0.100 | 40 | DR10 | 80 |
| 8 | Comp. Example | 2.0 | 0.222 | 88.9 | 0.200 | 10 | T3 | 57 |
| 9 | Comp. Example | 2.0 | 0.222 | 88.9 | 0.200 | 10 | T3 | 57 |
| 10 | Comp. Example | 1.6 | 0.214 | 86.7 | 0.150 | 30 | DR8 | 73 |
| 11 | This invention | 1.8 | 0.184 | 89.8 | 0.180 | 2 | T5 | 65 |
| 12 | This invention | 1.6 | 0.153 | 90.4 | 0.150 | 2 | T4 | 61 |
| 13 | This invention | 1.2 | 0.133 | 88.9 | 0.130 | 2 | T3 | 57 |
| 14 | This invention | 0.8 | 0.102 | 87.3 | 0.100 | 2 | T4 | 61 |
| 15 | This invention | 0.8 | 0.082 | 89.8 | 0.080 | 2 | T2 | 53 |
| 16 | This invention | 0.6 | 0.061 | 89.8 | 0.060 | 2 | T5 | 65 |
| 17 | This invention | 1.8 | 0.184 | 89.8 | 0.180 | 2 | T1 | 49 |
| 18 | This invention | 1.8 | 0.184 | 89.8 | 0.180 | 2 | T3 | 57 |
| 19 | This invention | 1.8 | 0.184 | 89.8 | 0.180 | 2 | T3 | 57 |
| 20 | This invention | 1.8 | 0.184 | 89.8 | 0.180 | 2 | T1 | 49 |

TABLE 5

| C content (wt %) | Annealing temperature (° C.) | Annealing time (sec) |
|---|---|---|
| less than 0.01 | 730 to 760 | 10 |
| 0.01 to less than 0.03 | 700 to 720 | 10 |
| 0.03 to 0.1 | 660 to 690 | 10 |

TABLE 6

| No | Remark | r value distribution of plating plate | | | | | | | | | Region (%) with variation of ≦±0.3 in length direction *2 |
|---|---|---|---|---|---|---|---|---|---|---|---|
| | | Portion corresponding to front end | | | Portion corresponding to center | | | Portion corresponding to rear end | | | |
| | | 5 mm from end *1 | Center *1 | Region (%) with variation of ≦±0.3 | 5 mm from end *1 | Center *1 | Region (%) with variation of ≦±0.3 | 5 mm from end *1 | Center *1 | Region (%) with variation of ≦±0.3 | |
| 1 | Example of this invention | 2.0 | 2.0 | 99 | 2.0 | 2.1 | 99 | 2.1 | 2.2 | 100 | 98 |
| 2 | | 1.9 | 2.0 | 98 | 1.9 | 2.0 | 99 | 1.9 | 2.0 | 99 | 97 |
| 3 | | 1.7 | 1.8 | 97 | 1.8 | 1.8 | 98 | 1.8 | 1.9 | 98 | 97 |
| 4 | | 1.6 | 1.7 | 98 | 1.7 | 1.7 | 98 | 1.7 | 1.8 | 100 | 97 |
| 5 | | 1.6 | 1.6 | 99 | 1.5 | 1.5 | 99 | 1.6 | 1.6 | 99 | 99 |
| 6 | | 1.5 | 1.5 | 97 | 1.5 | 1.5 | 97 | 1.7 | 1.7 | 97 | 96 |
| 7 | | 1.5 | 1.6 | 97 | 1.5 | 1.5 | 97 | 1.5 | 1.6 | 98 | 96 |
| 8 | Comparative example | 1.6 | 1.8 | 83 | 1.9 | 1.9 | 84 | 1.7 | 2.0 | 80 | 80 |
| 9 | | 0.8 | 1.2 | 70 | 1.8 | 1.9 | 81 | 1.6 | 1.9 | 78 | 75 |
| 10 | | 1.5 | 1.4 | 72 | 1.8 | 1.8 | 80 | 1.6 | 1.7 | 78 | 78 |
| 11 | Example of this invention | 1.6 | 1.8 | 95 | 1.7 | 1.8 | 96 | 1.6 | 1.9 | 95 | 95 |
| 12 | | 1.7 | 1.7 | 98 | 1.7 | 1.7 | 98 | 1.7 | 1.8 | 100 | 98 |
| 13 | | 1.3 | 1.5 | 99 | 1.4 | 1.4 | 98 | 1.4 | 1.6 | 97 | 97 |
| 14 | | 1.3 | 1.3 | 98 | 1.3 | 1.3 | 97 | 1.2 | 1.3 | 97 | 98 |
| 15 | | 1.2 | 1.3 | 98 | 1.3 | 1.3 | 99 | 1.3 | 1.4 | 99 | 99 |
| 16 | | 1.2 | 1.3 | 96 | 1.2 | 1.4 | 96 | 1.2 | 1.5 | 96 | 95 |
| 17 | | 1.8 | 1.9 | 99 | 1.9 | 2.0 | 99 | 1.8 | 1.9 | 99 | 99 |
| 18 | | 1.6 | 1.7 | 99 | 1.8 | 1.8 | 99 | 1.8 | 1.8 | 100 | 98 |
| 19 | | 1.7 | 1.8 | 98 | 1.7 | 1.8 | 99 | 1.7 | 1.8 | 100 | 98 |
| 20 | | 1.9 | 1.9 | 99 | 1.9 | 2.0 | 99 | 1.9 | 2.1 | 100 | 98 |

*1: In the width direction

*2: Including the center and the ends in the width direction.

TABLE 7

| | | Δr value distribution of plating plate | | | | | | | | | | | |
|---|---|---|---|---|---|---|---|---|---|---|---|---|---|
| | | Portion corresponding to front end | | | Portion corresponding to center | | | Portion corresponding to rear end | | | Region (%) with variation of ≦±0.2 in the length direction | Steel fabrication workability | |
| No | Remark | 5 mm from end *1 | Center *1 | Region (%) with variation of ≦±0.2 | 5 mm from end *1 | Center *1 | Region (%) with variation of ≦±0.2 | 5 mm from end *1 | Center *1 | Region (%) with variation of ≦±0.2 | | Necking in workability of 3-piece can | Scratching property of wall of 2-piece can |
| 1 | Example | −0.07 | −0.04 | 98 | −0.06 | −0.05 | 100 | −0.09 | −0.04 | 100 | 99 | o | o |
| 2 | of this | −0.04 | −0.07 | 99 | −0.04 | −0.02 | 99 | −0.07 | −0.01 | 99 | 99 | o | o |
| 3 | invention | −0.09 | −0.08 | 96 | −0.07 | −0.06 | 97 | −0.08 | −0.08 | 98 | 97 | o | o |
| 4 | | −0.10 | −0.08 | 98 | −0.09 | −0.08 | 99 | −0.09 | −0.08 | 100 | 98 | o | o |
| 5 | | −0.13 | −0.13 | 97 | −0.12 | −0.13 | 98 | −0.12 | −0.09 | 99 | 97 | o | o |
| 6 | | −0.20 | −0.24 | 99 | −0.25 | −0.20 | 100 | −0.20 | −0.19 | 100 | 99 | o | o |
| 7 | | −0.21 | −0.22 | 99 | −0.22 | −0.20 | 100 | −0.20 | −0.19 | 100 | 99 | o | o |
| 8 | Compara- | −0.48 | −0.40 | 86 | −0.20 | −0.15 | 87 | −0.46 | −0.26 | 86 | 87 | x | x |
| 9 | tive | −0.70 | −0.65 | 80 | −0.42 | −0.30 | 82 | −0.20 | −0.15 | 86 | 82 | x | x |
| 10 | Example | −0.56 | −0.45 | 84 | −0.25 | −0.20 | 85 | −0.46 | −0.24 | 86 | 85 | x | x |
| 11 | Example | −0.19 | −0.12 | 97 | −0.16 | −0.10 | 95 | −0.24 | −0.18 | 97 | 96 | o | o |
| 12 | of this | −0.17 | −0.15 | 99 | −0.16 | −0.15 | 100 | −0.21 | −0.22 | 99 | 99 | o | o |
| 13 | invention | −0.23 | −0.22 | 98 | −0.24 | −0.21 | 98 | −0.24 | −0.20 | 99 | 98 | o | o |
| 14 | | −0.22 | −0.23 | 100 | −0.24 | −0.20 | 99 | −0.24 | −0.23 | 99 | 99 | o | o |
| 15 | | −0.24 | −0.22 | 97 | −0.24 | −0.20 | 97 | −0.23 | −0.20 | 96 | 96 | o | o |
| 16 | | −0.24 | −0.16 | 95 | −0.24 | −0.14 | 96 | −0.23 | −0.18 | 95 | 95 | o | o |
| 17 | | −0.03 | −0.06 | 99 | −0.02 | −0.01 | 100 | −0.05 | −0.01 | 99 | 98 | o | o |
| 18 | | −0.19 | −0.18 | 98 | −0.17 | −0.16 | 99 | −0.19 | −0.20 | 99 | 99 | o | o |
| 19 | | −0.18 | −0.17 | 100 | −0.16 | −0.15 | 99 | −0.18 | −0.19 | 99 | 99 | o | o |
| 20 | | −0.02 | −0.05 | 99 | −0.01 | −0.02 | 98 | −0.04 | −0.02 | 99 | 98 | o | o |

*1: In the width direction

What is claimed is:

1. A method of producing a can steel strip from a steel slab comprising 0.1 wt % or less of C, 0.5 wt % or less of Si, 1.0 wt % or less of Mn, 0.1 wt % or less of P, 0.05 wt % or less of S, 0.20 wt % or less of Al, and 0.015 wt % or less of N, the method comprising hot rolling, coiling cold rolling, and annealing, wherein the hot rolling comprises heating at least both ends of a sheet bar obtained by rough rolling in the length direction of the sheet bar so that the temperature at both ends of the sheet bar in the length direction of the sheet bar is 15° C. or more higher than the temperature of the remainder of the sheet bar, and then finish-rolling the sheet bar at a rolling finish temperature of $Ar_3$+10° C. or more.

2. The method of producing a can steel strip according to claim 1, wherein the rolling finish temperature of the hot rolling is $Ar_3$+20° C. to $Ar_3$+100° C. in both ends of the sheet bar in the length direction of the sheet bar, and $Ar_3$+10° C. to $Ar_3$+60° C. in the remainder of the sheet bar, and the rolling finish temperature in the both ends of the sheet bar in the length direction is 10° C. or more higher than that of the remainder of the sheet bar.

3. The method of producing a can steel strip according to claim 1, wherein the finish-rolling of the hot-rolling comprises butt-joining sheet bars obtained by the rough rolling, and continuously rolling the sheet bar.

4. The method of producing a can steel strip according to claim 1, wherein the steel slab further comprises at least one element selected from at least one of Group A, Group B and Group C:

Group A; Nb: 0.10 wt % or less, Ti: 0.20 wt % or less,

Group B; B: 0.005 wt % or less,

Group C; Ca: 0.01 wt % or less, REM: 0.01 wt % or less; and wherein the balance comprising Fe and inevitable impurities.

5. A method of hot rolling a steel slab comprising 0.1 wt % or less of C, 0.5 wt % or less of Si, 1.0 wt % or less of Mn, 0.1 wt % or less of P, 0.05 wt % or less of S, 0.20 wt % or less of Al, and 0.015 wt % or less of N, the method comprising:

heating at least both ends of a sheet bar obtained by rough rolling in the length direction of the sheet bar so that the temperature at both ends of the sheet bar in the length direction of the sheet bar is 15° C. or more higher than the temperature of the remainder of the sheet bar; and then finish-rolling the sheet bar at a rolling finish temperature of $Ar_3$+10° C. or more.

6. The method of hot rolling a steel slab according to claim 5, wherein the rolling finish temperature of the hot rolling is $Ar_3$+20° C. to $Ar_3$+100° C. in both ends of the sheet bar in the length direction of the sheet bar, and $Ar_3$+10° C. to $Ar_3$+60° C. in the remainder of the sheet bar, and the rolling finish temperature in the both ends of the sheet bar in the length direction is 10° C. or more higher than that of the remainder of the sheet bar.

7. The method of hot rolling a steel slab according to claim 5, wherein the finish-rolling comprises butt-joining sheet bars obtained by the rough rolling, and continuously rolling the sheet bar.

8. The method of hot rolling a steel slab according to claim 5, wherein the steel slab further comprises at least one element selected from at least one of Group A, Group B and Group C:

Group A; Nb: 0.10 wt % or less, Ti: 0.20 wt % or less,

Group B; B: 0.005 wt % or less,

Group C; Ca: 0.01 wt % or less, REM: 0.01 wt % or less; and wherein the balance comprising Fe and inevitable impurities.

* * * * *